United States Patent [19]

Vazquez et al.

[11] Patent Number: 4,467,866

[45] Date of Patent: Aug. 28, 1984

[54] FLOW CONTROLLING APPARATUS

[75] Inventors: Gonzalo Vazquez; Neil H. Akkerman, both of Houston, Tex.

[73] Assignee: AVA International, Inc., Houston, Tex.

[21] Appl. No.: 358,128

[22] Filed: Mar. 17, 1982

[51] Int. Cl.[3] ..... E21B 23/03; E21B 43/12

[52] U.S. Cl. ..... 166/117.5; 166/313; 166/381

[58] Field of Search ..... 166/117.5, 313, 72, 166/321, 322, 332, 373, 374, 375, 380, 362, 381, 386

[56] References Cited

U.S. PATENT DOCUMENTS

| | | | |
|---|---|---|---|
| 2,973,036 | 2/1961 | Brown | 166/313 |
| 3,874,445 | 4/1975 | Terral | 166/117.5 |
| 4,119,146 | 10/1978 | Taylor | 166/72 |
| 4,249,599 | 2/1981 | Krause | 166/72 |
| 4,325,431 | 4/1982 | Akkerman | 166/117.5 |

*Primary Examiner*—James A. Leppink
*Assistant Examiner*—Hoang C. Dang
*Attorney, Agent, or Firm*—Vaden, Eickenroht, Thompson, Bednar & Jamison

[57] ABSTRACT

There is disclosed apparatus for use in controlling flow within a well bore wherein each of two or more well tubing strings are suspended from the head of the well, and a mandrel connected as a part of each string, in a position spaced vertically of the other mandrel connected to the other string, has a side pocket to one side of its bore to receive a fluid pressure responsive, flow controlling tool which is run into and out of the pocket on a wireline, as well as a second bore which receives a section of the other string for vertical movement with respect to the one string.

36 Claims, 6 Drawing Figures

2
3
4
61
24
23
46
40
34
35
36
42
29
28
57
33
56
58
20
32
30
27
44
22
54
55
53
21
52
60
S
50
51
39
37
38
43
41
25
26
31
31A
46A
24A
23A
61A
36A
35A
34A
42A
33A
29A
20A
32A
28A
22A
55A
53A
52A
SA
50A
38A
37A
43A
25A
26A
24B
31B
23B
46B
34B
35B
42B
36B
29B
20B
28B
44B
32B
63
30B
45B
62
33B
65
64
66
63A
43B
22B
37B
39B
38B
25B
67
26B

FLOW CONTROLLING APPARATUS

This invention relates generally to improvements in apparatus for use in controlling flow within a well bore wherein a mandrel connected to each of two or more well tubing strings suspended from the head of the well has a pocket to one side of its through bore to receive a flow controlling tool which is run on a wire line into and out of the pocket.

As well known in the art of parallel, multiple tubing string completions, each of the well tubing strings is packed off within the well bore or otherwise isolated from the other strings so that well fluids from individual production zones of the well may be separately produced through each string. In some cases, well fluid may be produced from still another production zone through the space within the well bore about the tubing strings, while, in others, the fluids may be circulated through the space and one or more of the tubing strings for various and sundry purposes. In order to land the tubing strings in the well bore, and cause them to be packed off at appropriate locations therein, it may be necessary that each string be raised or lowered relative to the other string. Also, of course, the strings are arranged as close together as possible so that the well bore is of the smallest possible diameter, and preferably not substantially greater than the sum of the tubing string diameters.

One or more of the wireline tools may be a gas lift valve having means therein for controlling flow between the bore of the mandrel and the space about the mandrel. Alternatively, and as shown in copending application Ser. No. 168,435 filed July 10, 1980, by Neil H. Akkerman, entitled "Flow Controlling Apparatus", and assigned to the assignee of the present application, the mandrel may be a subsurface tubing safety valve wherein a closure member is mounted on the mandrel for movement between positions opening and closing the bore therethrough, and the wire line tool is provided with means for normally holding the closure member open in response to the supply of control fluid thereto, but permitting it to close upon the exhaust of such fluid in the event of a predetermined "fail" condition. As also shown in such copending application, control fluid may be supplied to or exhausted from the fluid pressure responsive means of the tool by means of a control line extending within the space to connect with a source of control fluid to the wellhead.

In accordance with still another arrangement shown in copending application, Ser. No. 233,628, filed Feb. 17, 1981, by Neil H. Akkerman, entitled "Flow Controlling Apparatus", and also assigned to the assignee of the present invention, the wire line tool adapted to be landed within the side pocket of the mandrel contains an annulus safety valve having means responsive to the supply thereto for connecting the annulus above and below a packer about the mandrel, but responsive to the exhaust of control fluid therefrom, in the event of a fail condition, to prevent connection therebetween. As in the case of the tubing safety valve shown in the first-mentioned copending application, Ser. No. 168,435, control fluid is supplied to or exhausted from the fluid pressure responsive means within the tool through a control line extending between the wellhead and the pocket in which such tool is landed.

As explained in copending application, Ser. No. 168,435, conventional side pocket mandrels are made from a pair of side-by-side tubular members, one of which has a through bore with upper and lower ends for connection in axial alignment with the tubing string, and the other of which forms the side pocket formed therein with one end open to the bore. Thus, the side of the bored member is normally slotted along a midportion of its length to receive one side of the other tubular member, and, when so assembled, the members are welded to one another. In the completion of a well of the type contemplated by this invention, the strings are so oriented rotationally that the side pockets extend from them in generally opposite sides, and thus are disposed within portions of space about the string which would not be occupied if the strings were not provided with such mandrels, whereby the diameter of the well bore need not be substantially greater than the sum of the diameters of the well tubing strings.

However, as further explained in the aforementioned copending application, Ser. No. 168,435, there are circumstances under which it would be desirable to avoid welding the parts of the mandrel to one another. Thus, for example, axial misalignment of the bore and side pocket due to welding could interfere with the necessary cooperation of the parts operating therein, when, for example, the mandrel includes a subsurface safety valve as above described. It was therefore proposed, in accordance with such copending application, Ser. No. 168,435, to provide a side pocket mandrel having an outer body with axially aligned openings through its upper and lower ends adapted to be connected with the pipe string, and an intermediate section whose inner diameter is eccentric to the axes of the end openings, and to mount within the body, by threads or other non-welded means, an inner body having a first bore therethrough in substantial axial alignment with the end openings so as to form a continuation of the one string, and a pocket to one side of and substantially parallel to the bore having an end opening to the bore to receive the wire line tool. In the subsurface safety valve shown in such copending application, Ser. No. 168,435, a hole formed in the inner body is connected to a control line to permit control fluid from a source at the head of the well to be supplied to or exhausted from the fluid responsive means of the wire line tool for operating the closure member to control flow through the mandrel bore.

Although the mandrels shown in the application, Ser. No. 168,435, are improvements over conventional mandrels in this respect, their cylindrical shapes would, in a well installation of the type contemplated by this invention, require that the diameter of the well bore be considerably greater than that required to accommodate strings having conventional side pocket mandrels. Hence, it is the primary object of this invention to provide apparatus of the type above described wherein mandrels of such improved construction are so modified as to enable the tubing strings in which they are connected to be disposed sufficiently close together that the diameter of the well bore need not be substantially greater than that required in the installation of multiple strings having conventional type mandrels.

This and other objects are accomplished, in accordance with the illustrated embodiment of the present invention, by means of apparatus of the type described wherein the intermediate section of the mandrel connectible to each of the well tubing strings has, in addition to its first bore which forms a continuation of the tubing string, and a pocket to one side thereof to receive the flow controlling well tool, another or second bore which is parallel to the first bore and which receives a section of the other string for vertical movement with respect to the first-mentioned string. Thus, each such mandrel may be lowered with the string to which it is connected into a position spaced vertically of the mandrel connected to and lowered with each of the other strings, so that the strings may be disposed within a well bore of substantially no greater than that heretofore required. More particularly, a means is carried by each mandrel within the second bore thereof to form a sliding seal with the other string in order to separate well fluid within the first string from that within the space within the well bore about both strings.

In the illustrated embodiment of the invention, each mandrel has a hole therein to which a control line from the wellhead may be connected for supplying control fluid to or exhausting control fluid from the wire line landed in the pocket. Preferably, the hole extends through the mandrel for connection to a lower control line, whereby control fluid may be supplied to or exhausted from a fluid pressure, flow controlling means in the well bore beneath the mandrel, which means may be contained within another wire line tool landed in the pocket of a lower mandrel for controlling flow within another flow path within the well bore.

In the illustrated and preferred embodiment of the invention, a closure member is mounted on the intermediate section of at least one mandrel connected to each tubing string for movement between positions opening or closing the first bore thereof in response to the supply of control fluid to or exhaust of control fluid from the fluid pressure responsive means of wire line tool. Additionally, the first bore of a third mandrel connected with one of the strings is open, and a well tool is adapted to be run into the side pocket thereof for use in controlling flow within the space in the well bore about the strings, and thus for example through a bypass opening in a packer beneath the mandrels.

With reference now to the details of the above-described drawings:

FIG. 1 is a perspective view partly in section, of a first mandrel having a first bore adapted to be connected to a first well string, a second bore in which a section of a second well string is slidably received for vertical movement with respect to the first string, and a closure member for controlling flow through the first bore in response to the supply of control fluid or exhaust of control fluid from a wire line tool landed in a pocket of the mandrel to one side of each of the bores;

FIG. 1A is a view, similar to FIG. 1, of a second mandrel having a first bore connected to the second tubing string for lowering with the second string into a position beneath the first mandrel, a second bore in which the first string is sealably slidable for vertical movement with respect to the second string, and a closure member for controlling flow through the first bore, and thus within the second string, in response to the supply of control fluid to or exhaust of control fluid from a wire line tool landed in a pocket of the mandrel to one side of each of the bores;

FIG. 1B is a view, similar to each of views 1 and 1A, of a third mandrel having a first bore adapted to be connected to the first string for lowering therewith into a position beneath the second mandrel, and a second bore through which a section of the second tubing string is sealably slidable for vertical reciprocation with respect to the first string, and wherein a wire line tool is landed within a pocket of the third mandrel to one side of the bores for controlling flow within the space about the well bore in response to the supply of control fluid to or the exhaust of control fluid from fluid responsive mechanism within the tool;

Figures 1, 1A, 1B:
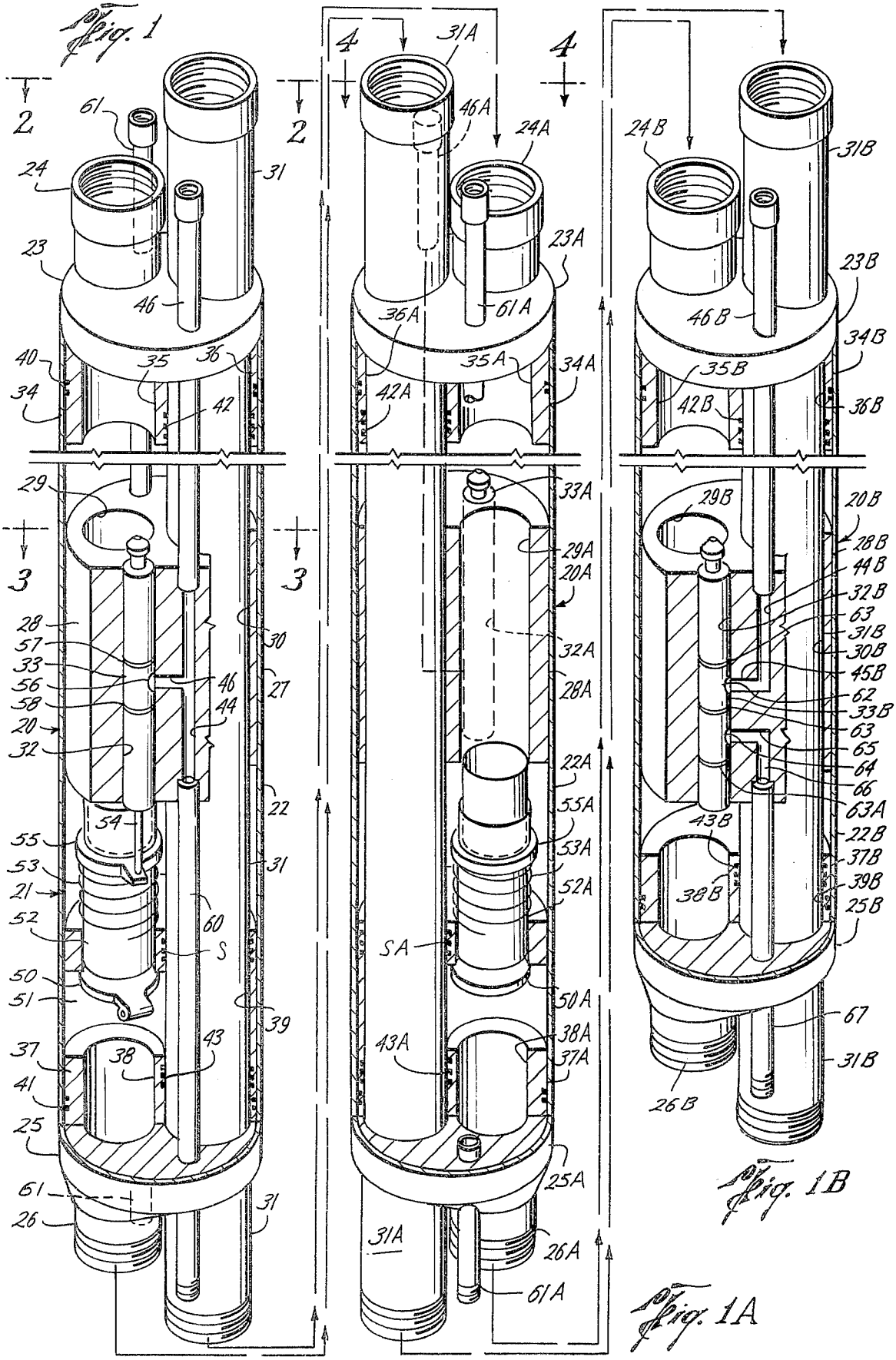

With reference now to the details of the above-described drawings, the first mandrel, which is indicated in its entirety by reference character 20, is shown in FIG. 1 to comprise an outer body 21 having axially aligned openings in its upper and lower ends. More particularly, the body comprises a tubular housing 22 having an upper end 23 to which an upper pipe connection 24 is connected, and a lower end 25 to which an axially aligned lower pipe connection 26 is connected, whereby the housing may be connected as part of a first well tubing string (not shown) suspended from the well head.

The housing 22 also includes an intermediate section 27 whose inner diameter is eccentric to the axes of the pipe connections 24 and 26, and the mandrel includes an inner body 28 which is closely received within the housing section 27. As will be described to follow, an intermediate section of the inner body includes a first bore 29 therethrough which is in substantial axial alignment with the end openings so as to form a continuation of the first well tubing string, a second bore 30 which is parallel to the first bore so as to receive a section 31 of the second well tubing for vertical movement with respect to the first string, and a pocket 32 to one side of and parallel to each of the bores 29 and 30 and having an upper end which opens to the first bore so that a wire line tool 33 may be run into and out of landed position therein. In keeping with the objects of the present invention, inner body 28 is mounted within the housing 22 by means which does not require welding, and which may, for example, correspond to the mounting means shown and described in the aforementioned application, Ser. No. 168,435. Thus, each of the bores 29 and 30 as well as pocket 32 is axially aligned with respect to the well tubing strings, and thus any tools which may be raised and lowered within the tubing strings.

As shown in FIG. 1, the inner body of the first mandrel 20 also includes, in addition to the intermediate section, an upper section 34 which is mounted in any suitable manner within the housing above the upper end of intermediate section and which has a first bore 35 therethrough axially aligned with the bore 29, and a second bore 36 therethrough axially aligned with the second bore 30 of the intermediate section. The inner body also includes a lower section 37 which is mounted within the housing 22 beneath the intermediate section 28 in any suitable manner, and which has a first bore 38 therethrough in axial alignment with the bore 29, and a second bore 39 in axial alignment with the bore 30.

Seal rings 40 are carried about the upper section 34 of the inner body for sealably engaging the inner diameter of the upper end of the housing, and seal rings 41 are carried about the outer diameter of the lower section 37 of the inner body for sealably engaging the inner diameter of the lower end of the housing. In addition, seal rings 42 are carried within the inner diameter of the second bore 36 of the upper section of the inner body to form a sliding seal with the upper portion of the pipe section 31, and seal rings 43 are carried within the inner diameter of the bore 39 of the lower section of the inner body to form a sliding seal with the lower portion of the pipe section 31. In this manner, well fluid within the housing 22 exteriorly of the pipe section 31, and thus within the first well pipe string, is separated from that within the space in the well bore about both pipe strings.

A hole 44 is formed vertically within the intermediate section 28 of the inner body of the mandrel for connection with a control line 46 extending downwardly from a suitable source at the head of the well (not shown) in order to permit control fluid to be supplied to or exhausted from the wire line tool 33 landed in the pocket 32. Thus, the hole 44 includes a laterally extending branch 46 leading to the pocket intermediate its upper and lower ends, and the control line extends through another hole formed in the upper end 23 of the housing as well as through the upper section of the inner body of the mandrel. The control line and the holes through which it is received are so arranged rotationally with respect to the first and second bores of the mandrel as to occupy an otherwise unoccupied space, preferably relatively near the pocket 32.

A closure member 50 is pivotally connected to the lower section of the inner body for movement between positions opening and closing the first bore 29 therethrough. More particularly, the closure member comprises a flapper which is mounted within a recessed portion 51 of the lower section of the inner body for swinging to and from a seated position across the lower end of the bore. As shown in the aforementioned copending application, Ser. No. 168,435, the closure member is normally urged by spring means to closed position, but is adapted to be swung downwardly to its open position by means of a flow tube 52 slidably received in the first bore of the inner body of the mandrel to form a continuation thereof, and normally urged to an upper position above the closure member 50 by means of a coil spring 53. Seal rings S are carried within the upper end of bore 39 to form a sliding seal about tubing section 31 which prevents well fluid within the first string from bypassing the flapper 50 when closed.

The flow tube is adapted to be moved downwardly to open the flapper 50 by means of a rod or plunger 54 extending from the lower end of wire line tool 33 to engage a collar 55 which is carried about the flow tube, and against which the upper end of the spring 53 acts to urge the flow tube to its upper position. Normally, a means within tool 33 will, in response to the supply of control fluid thereto, move the plunger downward to a further extended position, and thus overcome the force of spring 53 to lower the flow tube 52 and thus open the flapper 50. More particularly, as shown and described in the aforementioned application, Ser. No. 168,435, the plunger is so urged by the supply of control fluid to the fluid responsive means (not shown) through a port 56 in the tool 33 opposite the transverse hole 46 in the inner body of the mandrel and intermediate 0-rings 57 and 58 about the well tool sealably engaged with the pocket 32. Then, in response to a fail safe condition, the control fluid is exhausted through the control line back to its source to permit spring 53 to raise the flow and retract the plunger and thus close the flapper, as shown in FIG. 1A.

As also shown in FIG. 1, a lower control line 60 has its upper end connected to the lower end of hole 44 in the intermediate section of the inner body for extension downwardly through holes in the lower section 37 of the inner body and the lower end 25 of the housing 22, to permit the same control fluid to which tool 33 is responsive to be supplied to or exhausted from another fluid pressure responsive mechanism within the well bore beneath mandrel 20, which, of course, is adapted to be operated simultaneously with that within the well tool 33 for causing flapper 50 to open or close the first bore in the mandrel. Alternatively, however, such other mechanism may instead be operated by control fluid from another source or at least supplied or exhausted through a control line other than line 46, and thus independently of operation of tool 33.

Figure 2:
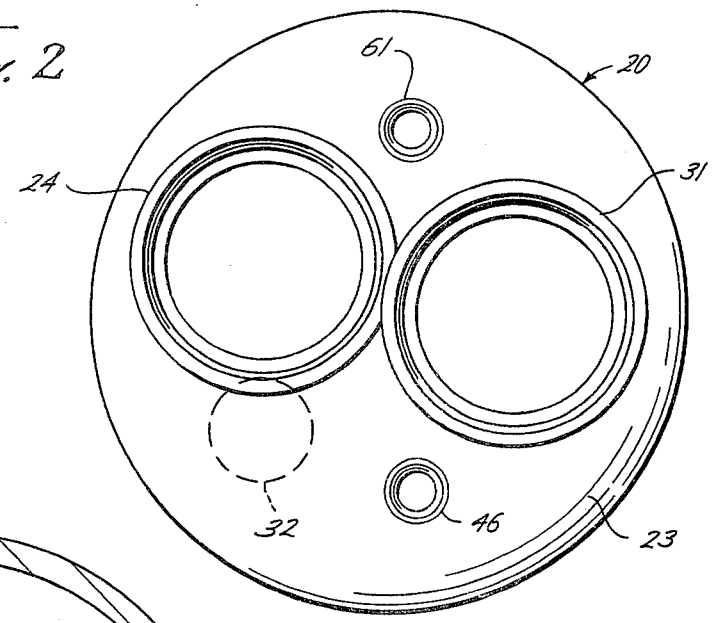
FIG. 2 is a top plan view of the first mandrel, as seen along broken, lines 2—2 of FIG. 1.
Figure 3:
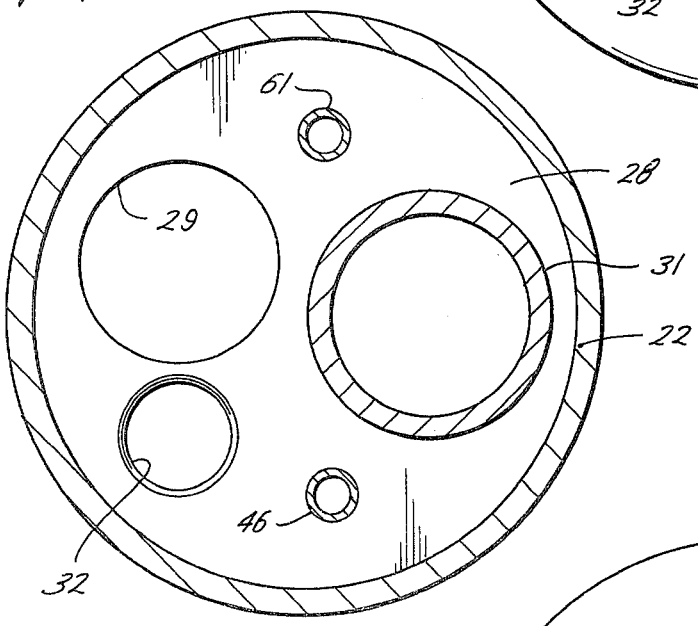
FIG. 3 is a cross-sectional view of the first mandrel, as seen,along broken lines 3—3 of FIG. 1.
Figure 4:
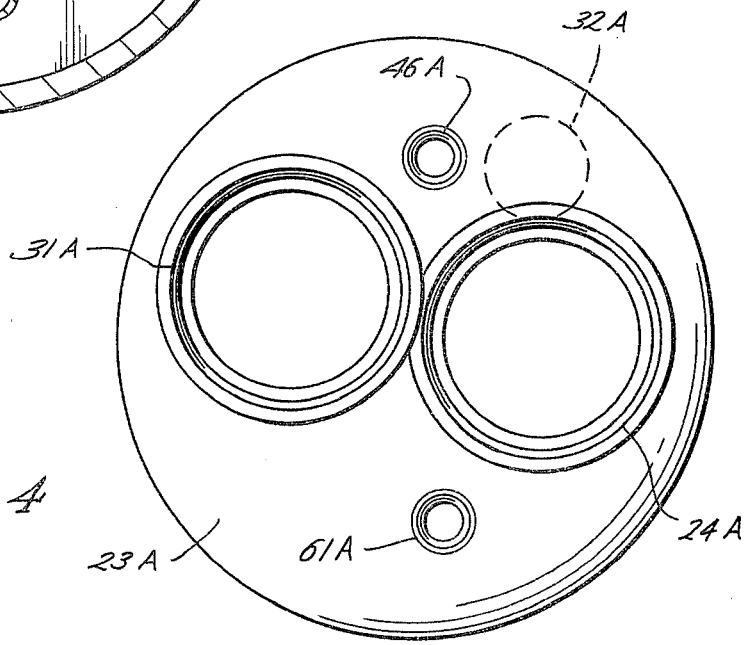
FIG. 4 is a top plan view of the second mandrel, as seen along broken lines 4—4 of FIG. 1A.

Still another control line 61 extends entirely through the mandrel for connection with a still further fluid responsive mechanism within the well bore beneath the first mandrel 20. As will be described, this further fluid responsive mechanism is contained within a tool landed within a side pocket of a lower mandrel adapted to be connected to the second tubing string and thus moved vertically with respect to the first string of well tubing. Hence, as in the case of the pipe section 31, control line 61 is free to move vertically through the mandrel, and for this purpose is sealably slidable within suitable seal means (not shown) in the upper and lower sections of the inner body of the first mandrel, much in the manner of the pipe section 31. As can be seen from FIGS. 2 and 3, control line 61 is also arranged rotationally with respect to the well tubing strings so as to occupy a space thereabout which is otherwise unoccupied, preferably on the side of the well tubing strings opposite that on which the control line 46 and pocket 32 are arranged.

The second mandrel, which is illustrated in FIG. 1A, and indicated in its entirety by reference character 20A, is of substantially identical construction to the mandrel 20. However, because the second mandrel is connected as part of the second tubing string, and receives a section 31A of the first pipe string for vertical movement with respect to it, it is arranged in a rotational sense essentially diametrically opposite the mandrel 20. Nevertheless, due to this similarity in construction, all of its parts which are identical to those of the mandrel 20 bear the same reference character with the addition of the suffix "A".

Thus, an upper pipe section 24A of the upper end 23A of the housing 22A of mandrel 20A is connected as a part of the second well tubing string for lowering therewith into the well bore beneath mandrel 20. Pipe section 24A may be directly connected to the lower threaded end of the pipe section 31 of mandrel 20, or to a lower section of the second tubing string. The upper end of pipe section 31A, on the other hand, is connected as part of the first pipe string, and thus either directly to the lower end of the lower pipe connection 26 or the lower end of a section of the first tubing string beneath it. Thus, as in the case of pipe section 31, pipe section 31A is vertically slidable within mandrel 20A so that it is free to move with the first tubing string vertically with respect to the second tubing string. Thus, as in the case of the mandrel 20, mandrel 20A includes an outer body comprising the intermediate housing section 22A and upper and lower ends 23A and 25A, with upper pipe section 24A connected to the upper end 23A and lower pipe section 26A connected to the lower end 25A. More particularly, the axes of the end openings in the pipe sections 24A and 26A are axially aligned with one another, but eccentric with respect to the inner diameter of the intermediate housing section 22A In addition, mandrel 20A includes an inner body 28 mounted within the inner diameter of the housing section 22A and comprising an upper section 34A, an intermediate section 28A and a lower section 37A.

Each of the upper and lower sections 34A and 37A, respectively, are identical to corresponding inner body sections of the mandrel 20, and the intermediate section 28A is identical to the intermediate section 28 of the inner body of the mandrel 20 in that it includes a bore 29A therethrough in axial alignment with the end connections 24A and 26A as well as the bores 35A and 38A through the upper and lower sections, respectively, of the inner body, as well as a bore 30A therethrough which is axially aligned with the bores 36A and 39A in the upper and lower sections of the inner body so as to receive, with such other bores, the pipe section 31A for vertical movement with respect thereto. More particularly, seal rings 42A and 43A are carried within the bores 36A and 39A to form a sliding seal with the pipe section 31A and thus separate well fluids within the housing of the mandrel 20A, and thus within the second pipe string from well fluids within the space about the tubing strings within the well bore.

The intermediate section of the inner body 28A is also similar to the inner body section of mandrel 20 in that it has a side pocket 32A formed therein to one side of and parallel to each of the parallel bores 29A and 30A so as to receive a wire line tool 33A through the open upper end thereof. Furthermore, the wire line tool 33A may be identical to the tool 33 in that it includes a mechanism which is responsive to the supply of control fluid to or the exhaust of control fluid from a suitable source at the wellhead for use causing a closure member to move between positions opening and close the bore 29 and thus the second string. That is, as described in connection with the tool 33, the supply of control fluid to such mechanism causes a rod or plunger mounted therein to be extended in order to lower flow tube 52A against the upwardly directed force of spring 53A, for causing closure member 50A to swing about its pivotal connection to the lower section of the inner body and thus open the bore 29A. Furthermore, as also described in connection with well tool 33, the exhaust of control fluid from the fluid responsive mechanism thereof permits the plunger or rod to be retracted, and thus the spring 53A to act upon collar 55A about the flow tube to raise the flow tube and thus permit the closure member 50A to be urged by suitable spring means (not shown) to the closed position shown in FIG. 1B. When the flapper is closed, as shown, in FIG. 1A, well fluid in the second string is prevented from bypassing it by means of seal rings 5A within the upper end of bore 43A which form a sliding seal about tubing section 31A.

As in the case of mandrel 20, control fluid from a source at the wellhead is supplied to or exhausted from the fluid responsive mechanism within tool 33A through a control line 46A which is identical to the control line 46 of the mandrel 20 in that it extends into the housing for connection with a hole in the intermediate section 28A of the inner body which leads to a port (not shown) in the well tool 33A connecting with its fluid responsive means. As indicated by the broken lines of FIG. 1A, the hole formed in the inner body 28A to receive the lower end of line 46A does not continue downwardly from its lateral connection to the side pocket 32A, and thus to a lower extension of the control line as in the case of control line 60 of the mandrel 20. Hence, control fluid is supplied to or exhausted from the tool 33A independently of not only tool 33, but also other fluid responsive mechanisms within the well bore.

Control fluid is supplied to or exhausted from the fluid pressure responsive means of the well tool landed in the pocket of the next lower mandrel of the apparatus through still another control line 61A adapted to be connected to the lower end of control line 46, either directly or through intermediate sections of control line. Similarly to the control line 61, control line 61A extends through sealed openings in the upper and lower ends 23A and 25A of the outer body of the mandrel 20A for vertical movement with respect to it. Inasmuch as it is movable vertically with respect to the mandrel 20A, control line 61A is free to move with the mandrel 20 and the first tubing string to which it's connected, and on which it is lowered into the well bore. More particularly, and as will be described to follow, control line 61A extends downwardly for connection with a control line leading into the third mandrel, which is below mandrel 20A and connected to the lower end of pipe section 31A of the mandrel 20A so as to permit it to be moved vertically within the first tubing string upon which the upper mandrel 20 is lowered.

This third mandrel, which is illustrated in FIG. 1B, and indicated in its entirety by reference character 20B, is similar in many respects to each of the mandrels 20 an 20A. Thus, corresponding parts thereof carry the same reference characters as those of the mandrels 20 and 20A, except for the addition or substitution of the suffix "B". On the other hand, as in the case of the second mandrel 20A with respect to the first mandrel 20, since it is connected as part of the first tubing string, and receives a section 31B of the second pipe string for vertical movement with respect to it, mandrel 20B is arranged in a rotational sense diametrically opposite to that of the second mandrel 20A, and thus in the same rotational sense as the first mandrel 20.

Thus, an upper pipe connection 24B on the upper end 23B of the housing 22B is connected to the lower end of pipe section 31A of the second mandrel, or to a section of the first tubing string below it, so as to permit it to be lowered with the first pipe string and the first mandrel into the well bore beneath the mandrel 20A. The upper end of pipe section 31B of the mandrel 20B is, on the other hand, connected as part of the second tubing string, either directly to the lower end of lower pipe connection 26A of mandrel 20A or to a section of the second tubing string beneath it. Thus, the third mandrel 20B is free to move with the first tubing string vertically with respect to the second tubing string.

As shown, the outer body of mandrel 20B is quite similar to that of the mandrels 20 and 20A in that pipe connections 24B and 26B on each end of intermediate section 22B provide end openings therein which are eccentric with respect to the inner diameter of the intermediate section, and further in that openings are formed in the ends 23B and 25B of the outer body to receive pipe section 31B for sliding vertically with respect thereto. The inner body 28B of the mandrel 20B is also similar to that of the mandrels 20 and 20A, although, like the outer body 20B, it is substantially shorter since mandrel 20B does not include a valve for opening and closing the bore therethrough which is axially aligned with the end openings 24B and 26C and thus with the first tubing string.

The upper section 34B of the inner body may be identical to that of the mandrels 20 and 20A in that it includes a bore 35B in axial alignment with the opening through upper pipe connection 24B, as well as a bore 36B which is parallel to the bore 35B and in axial alignment with the opening through the upper end of the outer body to receive pipe section 31B for vertical movement with respect thereto. In addition, seal rings 42B are carried within the bore 36B to form a sliding seal with the pipe section.

The lower section 37B of the inner body is also identical to the corresponding section of the mandrels 20 and 20A in that it includes a bore 35B in alignment with the end opening in lower pipe connection 26B, and a parallel bore 39B in axial alignment with the opening in the lower end 25B of the outer body as well as with the bore 36B in the upper section of the inner body so as to receive the pipe section 31B. In addition, seal rings 43B are carried within the bore 39B to form a sliding seal with the pipe section.

The intermediate section of the inner body 28B is similar to the corresponding sections of the other mandrels in that it includes a bore 29B in axial alignment with the bores 35B and 38B of the upper and lower sections of the inner body, as well as a bore 30B parallel to the bore 29B and in axial alignment with the bores 36B and 39B so as to receive pipe section 31B for vertical sliding with respect thereto. It also has a side pocket 32B formed therein to one side of and parallel to each of the bores 29B and 30B and with its open upper end positioned to receive wire line well tool 33B. Also, of course, the inner body section is non-weldably mounted within the outer body of the mandrel, as described in connection with the first and second mandrels.

As previously described, the fluid responsive means within the wire line tool 33B is not for the purpose of controlling flow through a bore of the mandrel forming a continuation of one of the well tubing strings, but rather for the purpose of controlling flow within the space in the well bore about the tubing strings. Thus, as shown and described, for example, in the aforementioned copending application, Ser. No. 233,628, well tool 33B may contain a valve for opening or closing passageways within the tool and mandrel which connect at one end with the space above a packer closing off the well bore beneath the mandrel, and at the other end with a control line leading to an opening which bypasses the packer to connect with the space within the well bore beneath it. More particularly, during normal conditions, the valve is moved to and held in open position in response to the supply of control fluid to the fluid pressure responsive means. However, in the event of an abnormality or fail condition, such control fluid is exhausted from the fluid pressure responsive means to permit the valve to move to closed position.

Since the details thereof form no part of the present invention, neither the valve nor the fluid pressure responsive means within the tool 33B is illustrated in FIG. 1B. Thus, insofar as the present invention is concerned, it is sufficient to note that control fluid may be supplied to or exhausted from the fluid pressure responsive means through a control line 46B extending sealably into the mandrel for connection at its lower end to the upper end of a hole 44B formed in the intermediate section 28B in the inner body of mandrel 20B, and a lateral extension 45B of hole 44B connecting with the pocket 32B opposite an upper port 62 of the well tool intermediate upper and middle 0-rings 63 carried by the tool for sealing with respect to the pocket. As will be understood from the aforementioned application, Ser. No. 233,628, the valve controlled passageway within the tool 33B is connected at one end with a hole in the mandrel connecting with the lower end thereof and at the other end with a lateral hole 65 in the mandrel leading to a vertical hole 66 to which the upper end of a lower control line 67 is connected. As shown in FIG. 1B, lateral hole 65 connects with the pocket 33B opposite port 64 in the tool which is disposed vertically between intermediate 0-ring 63 and lower 0-ring 63A carried by the tool for sealably engaging the pocket. Control line 67 in turn extends sealably through the lower section of the inner body and the lower end 25B of the outer body for connection at its lower end to the other fluid responsive mechanism within the well bore.

The upper end of conduit 46B connects with the lower end of control line 61A extending through the second mandrel, which in turn connects with the control line 46 of mandrel 20 for extension upwardly to a source of control fluid at the wellhead. Thus, the control fluid which is supplied to or exhausted from the fluid pressure responsive means of well tool 33B is from the same source as that supplied to or exhausted from the well tool 33. Obviously, however, the control lines may be so arranged and constructed that such control fluid may be from an entirely separate source. In any event, in the embodiment shown, wherein the control line 46B is connected to the control line 61A for movement vertically with it, and thus vertically with the first mandrel 20 and first tubing string.

In the installation of the dual tubing strings in accordance with the present invention, the mandrels would be connected thereto one above the other, as described above, and then lowered with the tubing strings into the well bore. As previously described, when the tubing strings have been lowered to the proper level, their upper ends are suspended in a well known manner from the wellhead, which may require some vertical movement of the tubing strings with respect to one another. This requirement is of course met by the present apparatus.

From the foregoing it will be seen that that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. Apparatus for use in controlling flow within one or more of a pair of well tubing strings adapted to be suspended from the head of the well and the annulus about the strings, comprising a mandrel having axially aligned openings through its upper and lower ends adapted to be connected with one of the pipe strings, whereby it may be lowered into the well bore, and an intermediate section whose outer diamefer is eccentric to the axes of the end openings, said intermediate section of the mandrel having a first bore therethrough in substantial axial alignment with the end openings so as to form a continuation of the one string, and a second bore parallel to the first bore and extending entirely through the upper and lower ends of the mandrel to receive the other pipe string for vertical movement with respect to the one string, said intermediate section of the mandrel also having a pocket to one side of and substantially parallel to each of the bores and having an end opening to the first bore through which a flow controlling tool may be run on a wired line through said one tubing string and first bore into and out of a landed position within the pocket.

2. Apparatus of the character defined in claim 1, wherein the mandrel has a hole therein to which a control line from the wellhead may be connected for supplying control fluid to or exhausting control fluid from fluid pressure responsive, flow controlling means of the wire line tool landed in the pocket.

3. Apparatus of the character defined in claim 2, wherein the hole extends through the mandrel for connection to a lower control line whereby control fluid may be supplied to or exhausted from fluid pressure responsive, flow controlling means in the well bore beneath the mandrel.

4. Apparatus of the character defined in claim 2, wherein the mandrel has another hole which extends through the mandrel and through which another control line from the wellhead may extend for supplying control fluid to or exhausting control fluid from fluid responsive means in the well bore beneath the mandrel.

5. Apparatus of the character defined in claim 2, including a closure member mounted on the intermediate section of the mandrel for movement between positions opening and closing said first bore, and means for moving the closure member between said positions in response to the supply of control fluid to or the exhaust of control fluid from the fluid responsive means of said wire line tool.

6. Apparatus for use in controlling flow within one or more of a pair of well tubing strings adapted to be suspended from the head of the well and the annulus about the strings, comprising a mandrel having axially aligned openings through its upper and lower ends adapted to be connected with one of the pipe strings, whereby it may be lowered into the well bore, and an intermediate section whose outer diameter is eccentric to the axes of the end openings, said intermediate section of the mandrel having a first bore therethrough in substantial axial alignment with the end openings so as to form a continuation of the one string, and a second bore parallel to the first bore and extending entirely through the upper and lower ends of the mandrel to receive the other pipe string for vertical movement with respect thereto, said intermediate section of the mandrel also having a pocket to one side of and substantially parallel to each of the bores and having an end opening to the first bore, and a flow controlling tool adapted to be run on a wire line tool through said tubing string and first bore into and out of landed position within the pocket.

7. Apparatus of the character defined in claim 6, wherein the mandrel has a hole in its upper end to which a control line from the wellhead may be connected for supplying control fluid to or exhausting control fluid from fluid responsive, flow controlling means of the wire line tool landed in the pocket.

8. Apparatus of the character defined in claim 7, wherein the hole extends through the mandrel for connection to a lower control line whereby control fluid may be supplied to or exhausted from fluid responsive, flow controlling means in the well bore beneath the mandrel.

9. Apparatus of the character defined in claim 7, wherein the mandrel has another hole which extends through the mandrel and through which another control line from the wellhead may extend for supplying control fluid to or exhausting control fluid from fluid responsive means in the well bore beneath the mandrel.

10. Apparatus of the character defined in claim 7, wherein a closure member is mounted on the intermediate section of the mandrel for movement between positions opening and closing said first bore, and means for moving the closure member between said positions in response to the supply of control fluid to or the exhaust of control fluid from the fluid responsive means of said tool.

11. Apparatus for use in controlling flow within one or more of a pair of well tubing strings adapted to be suspended from the head of the well and the annulus about the strings, comprising a mandrel having axially aligned openings through its upper and lower ends adapted to be connected with one of the pipe strings, whereby it may be lowered into the well bore, and an intermediate section whose inner diameter is eccentric to the axes of the end openings, said intermediate section of the mandrel having a first bore therethrough in substantial axial alignment with the end openings so as to form a continuation of the one string, and a second bore parallel to the first bore and extending entirely through the upper and lower ends of the mandrel, a pipe section adapted to be connected to the other pipe string and received within the second bore for vertical movement with respect to said one string, said intermediate section of the mandrel also having a pocket to one side of and substantially parallel to each of the bores and having an end opening to the first bore through which a flow controlling wire line tool may be run through said tubing string and first bore into and retrieved from a landed position within the pocket.

12. Apparatus of the character defined in claim 11, wherein the mandrel has a hole therein to which a control line from the wellhead may be connected for supplying control fluid to or exhausting control fluid from fluid responsive, flow controlling means of the wire line tool landed in the pocket.

13. Apparatus of the character defined in claim 12, wherein the hole extends through the mandrel for connection to a lower control line whereby control fluid may be supplied to or exhausted from fluid pressure responsive, flow controlling means in the well bore beneath the mandrel.

14. Apparatus of the character defined in claim 11, wherein the mandrel has another hole which extends through the mandrel and through which another control line from the wellhead may extend for supplying control fluid to or exhausting control fluid from fluid pressure responsive, flow controlling means in the well bore beneath the mandrel.

15. Apparatus of the character defined in claim 11, including a closure member mounted on the inntermediate section of the mandrel for movement between positions opening and closing said first bore, and means for moving the closure member between said positions in response to the supply of control fluid to or the exhaust of control fluid from the fluid responsive means of said wire line tool.

16. Apparatus for use in controlling flow within one or more of a pair of well tubing strings adapted to be suspended from the head of the well and the annulus about the strings, comprising a mandrel having an outer body with axially aligned openings through its upper and lower ends adapted to be connected with one of the pipe strings, whereby it may be lowered into the well bore, and an intermediate section whose outer diameter is eccentric to the axes of the end openings, said intermediate section of the mandrel having a first bore therethrough in substantial axial alignment with the end openings so as to form a continuation of the one string, and a second bore parallel to the first bore and extending entirely through the upper and lower ends of the mandrel, a pipe section adapted to be connected to the other pipe string and received within the second bore for vertical movement with respect to the one string, said intermediate section of the mandrel also having a pocket to one side of and substantially parallel to each of the bores and having an end opening to the first bore, and a flow controlling tool adapted to be run on a wire line through said one tubing string and first bore into and out of a landed position within the pocket.

17. Apparatus of the character defined in claim 16, wherein the mandrel has a hole therein to which a control line from the wellhead may be connected for supplying control fluid to or exhausting control fluid from the fluid pressure responsive, flow controlling means of the wire line tool landed in the pocket.

18. Apparatus of the character defined in claim 17, wherein the hole extends through the mandrel for connection to a lower control line whereby control fluid may be supplied to or exhausted from fluid pressure responsive, flow controlling means in the well bore beneath the mandrel.

19. Apparatus of the character defined in claim 17, wherein the mandrel has another hole which extends through the mandrel and through which another control line from the wellhead may extend for supplying control fluid to or exhausting control fluid from fluid pressure responsive means in the well bore beneath the mandrel.

20. Apparatus of the character defined in claim 17, wherein a closure member is mounted on the intermediate section of the mandrel for movement between positions opening and closing said first bore, and means for moving the closure member between said positions in response to the supply of control fluid to or the exhaust of control fluid from the fluid pressure responsive means of said tool.

21. Apparatus for use in controlling flow within one or more of a pair of well tubing strings adapted to be suspended from the head of the well and the annulus about the strings, comprising a first mandrel having axially aligned openings through its upper and lower ends adapted to be connected with a first of the pipe strings, whereby it may be lowered into the well bore, and an intermediate section whose outer diameter is eccentric to the axes of the end openings, said intermediate section of the first mandrel having a first bore therethrough in substantial axisl alignment with the end openings so as to form a continuation of the first string, and a second bore parallel to the first bore and extending entirely through the upper and lower ends of the mandrel to receive a section of the second of the pipe string for vertical movement with respect to the first string, a second mandrel having axially aligned openings through its upper and lower ends adapted to be connected with the second pipe string, whereby it may be lowered into a position within the well bore vertically spaced from the first mandrel, and an intermediate section whose outer diameter is eccentric to the axes of the end openings, said intermediate section of the second mandrel having a first bore therethrough in substantial axial alignment with the end openings so as to form a continuation of said second string, and a second bore parallel to the first bore and extending entirely through the upper and lower ends of the mandrel to receive a section of the first pipe string for vertical movement with respect to the second string, the intermediate section of each mandrel also having a pocket to one side of and substantially parallel to each of the bores thereof and having an end opening to the first bore through which a flow controlling tool may be run on a wire line through the tubing string to which the mandrel is connected and its first bore into and out of a landed position within the pocket.

22. Apparatus of the character defined in claim 21, including a third mandrel having axially aligned openings through its upper and lower ends adapted to be connected with one of the first or second tubing strings, whereby it may be lowered therewith into a position within the well bore vertically spaced from each of the first and second bores, and an intermediate section whose outer diameter is eccentric to the axes of the end openings, said intermediate section of the mandrel having a first bore therethrough in substantial axial alignment with the end openings so as to form a continuation of the one string, and a second bore parallel to the first bore and extending entirely through the upper and lower ends of the mandrel to receive a section of the other of the first or second tubing strings for vertical movement with respect thereto, the intermediate section of said third mandrel also having a pocket to one side of and substantially parallel to each of the bores thereof and having an end opening to the first bore through which a flow controlling tool may be run on a wire line through said one mandrel and the first bore of each into and out of landed position within the pocket.

23. Appartus of the character defined in claim 22, wherein the intermediate section of each of the to mandrels has a hole therein to which a contropl line may be connected for supplying control fluid to or exhausting control fluid from a fluid pressure responsive, flow controlling means of the wire line tool landed in the pocket thereof.

24. Apparatus of the character defined in claim 21, wherein each of the mandrels has a hole therein to which a control line may be connected for supplying control fluid to or exhausting control fluid from a fluid pressure responsive, flow controlling means of the wire line tool landed in the pocket thereof.

25. Apparatus of the character defined in claim 24, wherein a closure member is mounted on the intermediate section of each mandrel for movement between positions opening and closing the first bore thereof, and means for moving the closure member between said positions in response to the supply of control fluid to or the exhaust of control fluid from the fluid pressure responsive means of the tool landed in the pocket of said mandrel.

26. Apparatus for use in controlling flow within one or more of a pair of well tubing strings adapted to be suspended from the head of the well and the annulus about the strings, comprising a mandrel including a housing having axially aligned openings through its upper and lower ends adapted to be connected with one of the pipe strings, whereby it may be lowered into the well bore, and an intermediate section whose inner diameter is eccentric to the axes of the end openings, an inner body within the intermediate housing section of the housing, said inner body having vertically spaced sections which define a chamber therebetween, each section of the inner body having a first bore therethrough in substantial axial alignment with the end openings in the housing so as to form a continuation of the one string, and a second bore therethrough parallel to the first bore and extending entirely through the upper and lower ends of the housing to receive the other pipe string for vertical movement with respect to the one string, and means within the second bore in each section of the inner body to form a sliding seal with the other string in order to separate well fluid within the chamber from that within the space in the well bore about both strings, one of said sections of the inner body also having a pocket to one side of and substantially parallel to each of the bores and having an end opening to the chamber whereby a flow controlling tool may be run on a wire line through said one tubing string and first bore into and out of a landed position within the pocket.

27. Apparatus of the character defined in claim 26, wherein said inner body includes a further section which is vertically spaced below said one section to define another chamber therebetween, and a closure member is mounted on the inner body for movement within the other chamber between positions opening and closing the second bore in response to the supply and exhaust of control fluid to and from said wire line tool.

28. Apparatus for use in controlling flow within well tubing strings adapted to be suspended from the head of the well and the annulus about the strings, comprising a mandrel including a housing having axially aligned openings through its upper and lower ends adapted to be connected with one of the pipe strings, whereby it may be lowered into the well bore, and an intermediate section whose inner diameter is eccentric to the axes of the end openings, an inner body within the intermediate section of the housing, said inner body having vertically spaced sections which define a chamber therebetween, each section of the inner body having a first bore therethrough in substantial axial alignment with the end openings in the housing so as to form a continuation of the one string, and a second bore therethrough parallel to the first bore and extending entirely through the upper and lower ends of the housing to receive the other pipe string for vertical movement with respect thereto, means within the second bore to form a sliding seal with the other string in order to separate well fluid within the one string from that within the space in the well bore about both strings, one section of the inner body of the mandrel also having a pocket to one side of and substantially parallel to each of the bores and having an end opening to the chamber, and a flow controlling tool adapted to be run on a wire line tool through said tubing string and first bore into and out of landed position within the pocket.

29. Apparatus of the character defined in claim 28, wherein said inner body includes a further section which is vertically spaced below said one section to define another chamber therebetween, and a closure member is mounted on the inner body for movement within the other chamber between positions opening and closing the second bore in response to the supply and exhaust of control fluid to and from said wire line tool.

30. Apparatus for use in controlling flow within one or more of well tubing strings adapted to be suspended from the head of the well and the annulus about the strings, comprising a mandrel including a housing having axially aligned openings through its upper and lower ends adapted to be connected with one of the pipe strings, whereby it may be lowered into the well bore, and an intermediate section whose diameter is eccentric to the axes of the end openings, an inner body within the intermediate section of the housing, said inner body having vertically spaced sections which define a chamber therebetween, each section of the inner body having a first bore therethrough in substantial axial alignment with the end openings in the housing so as to form a continuation of the one string, and a second bore therethrough parallel to the first bore and extending entirely through the upper and lower ends of the housing, a pipe section adapted to be connected to the other pipe string and received within the second bore for vertical movement with respect to said one string, and means within the second bore forming a sliding seal with the other string in order to separate well fluid wihtin the one string from that within the space in the well bore about both strings, one section of the inner body of the mandrel also having a pocket to one side of and substantially parallel to each of the bores and having an end opening to the chamber through which a flow controlling wire line tool may be run through said tubing string and first bore and retrieved from a landed position within the pocket.

31. Apparatus of the character defined in claim 30, wherein said inner body includes a further section which is vertically spaced below said one section to define another chamber therebetween, and a closure member is mounted on the inner body for movement within the other chamber between positions opening and closing the second bore in response to the supply and exhaust of control fluid to and from said wire line tool.

32. Apparatus for use in controlling flow within one or more of well tubing strings adapted to be suspended from the head of the well and the annulus about the strings, comprising a mandrel including a housing having axially aligned openings through its upper and lower ends adapted to be connected with one of the pipe strings, whereby it may be lowered into the well bore, and an intermediate section whose outer diameter is eccentric to the axes of the end openings, an inner body within the intermediate section of the housing, said inner body having vertically spaced sections which define a chamber therebetween, each section of the inner body having a first bore therethrough in substantial axial alignment with the end openings in the housing so as to form a continuation of the one string, and a second bore therethrough parallel to the first bore and extending entirely through the upper and lower ends of the housing, a pipe section adpated to be connected to the other pipe string and received within the second bore for vertical movement with respect to the one string, means within the second bore forming a sliding seal with the other string in order to separate well fluid within the one string from that within the space in the well bore about both strings, one section of the inner body of the mandrel also having a pocket to one side of and substantially parallel to each of the bores and having an end opening to the chamber, and a flow controlling tool adapted to be run on a wire line through said one tubing string and first bore into and out of a landed position within the pocket.

33. Apparatus of the character defined in claim 32, wherein said inner body includes a further section which is vertically spaced below said one section to define another chamber therebetween, and a closure member is mounted on the inner body for movement within the other chamber between positions opening and closing the second bore in response to the supply and exhaust of control fluid to and from said wire line tool.

34. Apparatus for use in controlling flow within one or more of well tubing strings adapted to be suspended from the head of the well and the annulus about the strings, comprising a first mandrel including a housing having axially aligned openings through its upper and lower ends adpated to be connected with a first of the pipe strings, whereby it may be lowered into the well bore, and an intermediate section whose inner diameter is eccentric to the axes of the end openings, an inner body within the intermediate section of the housing, said inner body having vertically spaced sections which define a chamber therebetween, each section of the housing of the first mandrel having a first bore therethrough in substantial axial alignment with the end openings in the housing thereof so as to form a continuation of the first string, and a second bore parallel to the first bore and extending entirely through the upper and lower ends of said housing to receive a section of the second of the pipe string for vertical movement with respect to the first string, means within the second bore to form a sliding seal with the second string in order to separate well fluid within the first string from that within the space in the well bore about both strings, a second mandrel including a housing having axially aligned opening through its upper and lower ends adapted to be connected with the second pipe string, whereby it may be lowered into a position within the well bore vertically spaced from the first mandrel, and an intermediate section whose inner diameter is eccentric to the axes of the end openings, an inner body within the intermediate section of the housing, said inner body having vertically spaced sections which define a chamber therebetween, each section of the inner body of the second mandrel having a first bore therethrough in substantial axial alignment with the end openings in the housing thereof so as to form a continuation of said second string, and a second bore therethrough parallel to the first bore and extending entirely through the upper and lower ends of said housing to receive a section of the first pipe string for vertical movement with respect to the second string, and means within the second bore a sliding seal with the first string in order to separate well fluid within the second string from that within the space within the well bore about both strings, one section of the inner body of each mandrel also having a pocket to one side of and substantially parallel to each of the bores thereof and having an end opening to the first bore through which a flow controlling tool may be run on a wire line through the tubing string to which the mandrel is connected and its first bore into and out of a landed position within the pocket.

35. Apparatus of the character defined in claim 34, wherein said inner body includes a further section which is vertically spaced below said one section to define another chamber therebetween, and a closure member is mounted on the inner body for movement within the other chamber between positions opening and closing the second bore in response to the supply and exhaust of control fluid to and from said wire line tool.

36. Apparatus of the character defined in claim 34, including a third mandrel including a housing having axially aligned openings through its upper and lower ends adapted to be connected with one of the first or second tubing strings, whereby it may be lowered therewith into a position within the well bore vertically spaced from each of the first and second mandrels, and an intermediate section whose inner diameter is eccentric to the axes of the end openings, an inner body within the intermediate section of the housing, said inner body having vertically spaced sections which define a chamber therebetween, each section of the housing of the third mandrel having a first bore therethrough in substantial axial alignment with the end openings in the housing thereof so as to form a continuation of the one string, and a second bore parallel to the first bore and extending entirely through the upper and lower ends of said housing to receive a section of the other of the first or second tubing strings for vertical movement with respect thereto, and means within the second bore to form a sliding seal with the other string in order to separate well fluid within the one string from that within space in the well bore about both strings, one section of the inner body of said third mandrel also having a pocket to one side of and substantially parallel to each of the bores thereof and having an end opening to the first bore through which a flow controlling tool may be run on a wire line through said one mandrel and the first bore of each into and out of a landed position within the pocket.

* * * * *